US008485103B2

(12) United States Patent
Miller et al.

(10) Patent No.: US 8,485,103 B2
(45) Date of Patent: Jul. 16, 2013

(54) RAIL ANCHOR SPREADER AND COMBINATION SPIKE PULLER

(75) Inventors: Robert S. Miller, Columbia, SC (US); Anthony P. DeLucia, Gaston, SC (US)

(73) Assignee: Harsco Corporation, Camp Hill, PA (US)

( * ) Notice: Subject to any disclaimer, the term of this patent is extended or adjusted under 35 U.S.C. 154(b) by 150 days.

(21) Appl. No.: 13/021,621

(22) Filed: Feb. 4, 2011

(65) Prior Publication Data

US 2012/0199037 A1 Aug. 9, 2012

(51) Int. Cl.
*E01B 29/24* (2006.01)

(52) U.S. Cl.
USPC ..... 104/17.2

(58) Field of Classification Search
USPC ..... 104/2, 4–6, 16, 17.1, 17.2
See application file for complete search history.

(56) References Cited

U.S. PATENT DOCUMENTS 3,690,264 A 9/1972 Plasser et al.
4,538,793 A 9/1985 Dieringer et al.
4,890,558 A 1/1990 Quella et al.
5,117,760 A 6/1992 Almaraz et al.
5,438,931 A 8/1995 Becker et al.
6,662,729 B1 * 12/2003 Madison ..... 104/17.2
7,353,757 B2 * 4/2008 Eldridge ..... 104/17.1

OTHER PUBLICATIONS

PCT International Search Report & Written Opinion, 15 pages, Sep. 2012.

* cited by examiner

*Primary Examiner* — R. J. McCarry, Jr.

(74) *Attorney, Agent, or Firm* — McNees Wallace & Nurick LLC

(57) ABSTRACT

An anchor spreader apparatus and method for moving rail anchors, the anchor spreader apparatus has a mounting member, a rail clamp assembly and an anchor-engaging assembly. With the rail clamp assembly properly clamped to the rail, the anchor spreader apparatus is maintained in a proper and controlled position relative to the anchor as the anchor-engaging assembly is rotatably moved relative to the rail clamp assembly. The anchor spreader apparatus may be paired with a spike-pulling apparatus, whereby the anchor spreader apparatus and the spike-pulling apparatus simultaneously move the rail anchor and pull respective spikes.

24 Claims, 12 Drawing Sheets

RAIL ANCHOR SPREADER AND COMBINATION SPIKE PULLER

FIELD OF THE INVENTION

The present invention relates to railway maintenance. More specifically, the present invention provides an improved rail anchor spreader and an improved combination rail anchor spreader and rail spike puller.

BACKGROUND OF THE INVENTION

The rails of a railroad track are usually secured to cross ties by spikes driven into tie plates, with the tie plates located between the rail and the tie, and the head of the spike overlapping the bottom of the rail. The tie plates block lateral movement of the rails, and anchors attached to the rail on either side of the tie are used to secure the rail against longitudinal movement.

Railroad ties occasionally must be replaced due to wear. When a tie must be replaced, the spikes are first removed. Next, the anchors are spread away from the ties to provide space for removal of the old tie and insertion of the new tie.

Various methods of removing and/or spreading rail anchors are known in the industry. One example is U.S. Pat. No. 4,890,558, issued to D. C. Quella et al. on Jan. 2, 1990. This patent describes an anchor spreader having a head assembly with a pair of telescoping spreader plates, controlled by hydraulic cylinders, for pushing the anchors away from the ties. The head assembly includes stop members to control the height of the head during an anchor-spreading operation. A rail clamp prevents longitudinal movement of the head during an anchor-spreading operation.

U.S. Pat. No. 4,903,611, issued to J. D. Holley on Feb. 27, 1990, describes an anchor-spreading mechanism having an anchor-spreading head, and a rail clamp. The vertical position of the head is controlled by a hydraulic cylinder. After lowering the head and clamping the rail, horizontal hydraulic cylinders located adjacent to the pusher, and in close proximity to the ballast, cause a pusher to be moved back and forth, pushing the tie plate off the tie in one direction, and then the other direction, thereby moving the anchors away from the tie.

U.S. Pat. No. 5,074,219, issued to J. Theurer et al. on Dec. 24, 1991, describes a rail anchor removing vehicle having the carrier arms for the anchor remover heads directly below the cab. The cab of the vehicle has a transparent floor. The carrier frame rests on a flanged wheel that rolls along the rail during the anchor removal operation. Each anchor remover head includes a hammer for driving the field side of the anchor downward, and a stripping element for pulling the anchor out from under the track, towards the gauge side. The hammer may include a horizontal portion for driving the anchor downward, and a vertical portion for driving the anchor toward the gauge side of the rail. A magnetic anchor-collecting drive retrieves the anchors and transfers them to a conveyor, which transports them to a storage container.

U.S. Pat. No. 5,117,760, issued to R. Almarez et al. on Jun. 2, 1992, describes a rail anchor spreader having a pair of spreader bars with interchangeable spreader plates at their tips for engaging different rail anchors. A limit switch controls the vertical positioning of the spreader assembly. Each spreader bar is pulled outward by a hydraulic cylinder to move its anchor, with its limit of travel set by placing a threaded bolt at the maximum outward travel position.

U.S. Pat. No. 5,277,122, issued to R. Almaraz et al. on Jun. 11, 1994, describes a rail anchor adjuster for moving railway anchors towards the tie. The anchor adjuster includes a pair of pivoting arms having top ends connected by a hydraulic cylinder, and bottom ends dimensioned and configured to engage the rail anchors. The height of the anchor adjuster assembly is controlled by interchangeable stop pads.

U.S. Pat. No. 5,438,931, issued to N. W. Becker et al. on Aug. 8, 1995, describes a rail anchor remover having a telescoping ram assembly for driving the tail of the anchor below the base of the rail, a kicker assembly for driving the anchor transversely under the rail towards the gauge side of the rail, and a window assembly for driving the anchor away from the rail.

U.S. Pat. No. 5,546,864, issued to W. Straub et al. on Aug. 20, 1996, describes a rail anchor remover having a reciprocating pusher for pushing the anchor downward away from the rail, and a reciprocating scraper for pulling the anchor out from under the rail. Proximity switches are used to monitor the position of the pusher and scraper. A similar device is described in U.S. Pat. No. 5,730,060 also issued to W. Straub et al., on Mar. 24, 1998.

U.S. Pat. No. 5,915,744, issued to S. G. Cotsford on Jun. 29, 1999, and assigned to Harsco Corporation, the assignee of the present invention, describes a rail anchor removal machine and method using anchor-removing rollers, and a conveyor system for moving the removed anchors to the side of the railroad track. The anchors are removed by angled rollers as the rail is raised, which push the anchors downward and towards the gauge side of the track as they roll over the anchor. A funnel-like anchor catch deflects the removed anchors towards a conveyor, which deposits them alongside the track.

U.S. Pat. No. 6,662,729, issued to H. Madison on Dec. 16, 2003, and assigned to Harsco Corporation, the assignee of the present invention, describes a railway anchor spreader with a rotating plate on each side of each rail, with the bottom of each rotating plate having a pair of jaws. The tie plates are lowered until the jaws strike the ballast, and the tie plates are then pivoted first in one direction, and then in the opposite direction, by a hydraulic cylinder located near the top of the anchor spreader plates. The jaws will thereby strike the tie plates, first pushing them in one direction and then in the opposite direction, to move the rail anchors away from the tie.

Many of the above-described patents propose devices requiring that the height of the anchor spreader be adjusted and set each time it is used with a different height rail. Furthermore, the means for properly positioning the anchor spreader must, in addition to properly positioning the spreader, ensure that movement of the spreader to spread the anchors does not pose a risk of striking the ties. Accordingly, there is a need for an anchor spreader capable of being used with multiple heights of rail without adjustments. Additionally, there is a need for an anchor spreader which can be moved into position without striking the anchor or other components of the railway. Further, some of the above-described references position hydraulic cylinders relatively close to the ballast surrounding the ties, resulting in the potential for interference between this ballast and the hydraulic cylinders. Accordingly, there is a need for a railway anchor spreader having hydraulic cylinders and other components kept away from the ballast.

While the prior art describes many types of spike pullers and anchor spreaders, these devices are positioned on separate and distinct pieces of maintenance equipment, with each of the equipment requiring at least on operator for operation. There is a need, therefore, for a railway maintenance vehicle which combines the function of a spike puller and an anchor spreader, thereby eliminating the expense of different maintenance vehicles and reducing the number of operators required to perform the maintenance.

SUMMARY OF THE INVENTION

An exemplary embodiment includes an anchor spreader apparatus for moving rail anchors, which are secured to a rail, away from a tie. The anchor spreader apparatus is mounted on a rail vehicle. The anchor spreader apparatus has a mounting member, a rail clamp assembly and an anchor-engaging assembly. The rail clamp assembly is movably mounted on the mounting member to allow a clamping surface of the rail clamp to move into engagement with the rail. The anchor-engaging assembly is movably mounted on the mounting member to allow an anchor-engaging jaw to move into engagement with a respective rail anchor and to allow the anchor-engaging assembly to move relative to the rail clamp assembly. With the rail clamp assembly properly clamped to the rail, the anchor spreader apparatus is maintained in a proper and controlled position relative to the anchor as the anchor-engaging assembly is moved relative to the rail clamp assembly.

An exemplary embodiment of a rail vehicle for performing maintenance on at least one rail, the rail vehicle includes an anchor spreader apparatus and a spike-pulling apparatus. The anchor spreader apparatus has a rail clamp assembly and an anchor-engaging assembly. The rail clamp assembly cooperates with the at least one rail to properly position and maintain the anchor spreader apparatus in position relative to the at least one rail. The anchor-engaging assembly has an anchor-engaging jaw which engages and moves an anchor of the at least one rail. The spike-pulling apparatus has multiple spike-pulling heads which cooperate with respective spikes to pull the spikes from tie plates associated with the at least one rail. The anchor spreader apparatus and the spike-pulling apparatus simultaneously move the anchor and pull the spikes.

An exemplary method of for moving a rail anchor from a rail tie, the method comprising the steps of: moving a rail anchor spreader apparatus into position over the rail anchor; positioning clamping surfaces of the rail anchor spreader apparatus into engagement with the rail to maintain the rail anchor spreader apparatus in position relative to a rail on which the rail anchor is positioned; rotating anchor-engaging jaws into engagement with the rail anchor; and moving the anchor-engaging jaws toward the clamping surfaces. With the clamping surfaces in engagement with the rail, the anchor-engaging jaws engage the rail anchor as the anchor-engaging jaws are moved toward the clamping surface, causing the rail anchor to be moved relative to the tie.

An exemplary method for moving a rail anchor from a rail tie and pulling at least one spike from a tie plate, the method comprising the steps of: moving a vehicle having a rail anchor-spreader apparatus and a spike-pulling apparatus into position over the rail anchor; moving spike-pulling heads into engagement with the at least one spike; pulling the at least one spike from the tie plate; positioning clamping surfaces of the rail anchor-spreader apparatus into engagement with the rail to maintain the rail anchor-spreader apparatus in position relative to a rail on which the rail anchor is positioned; rotating anchor-engaging jaws into engagement with the rail anchor; and moving the anchor-engaging jaws toward the clamping surfaces. With the clamping surfaces in engagement with the rail, the anchor-engaging jaws engage the rail anchor as the anchor-engaging jaws are moved toward the clamping surface, causing the rail anchor to be moved relative to the tie.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
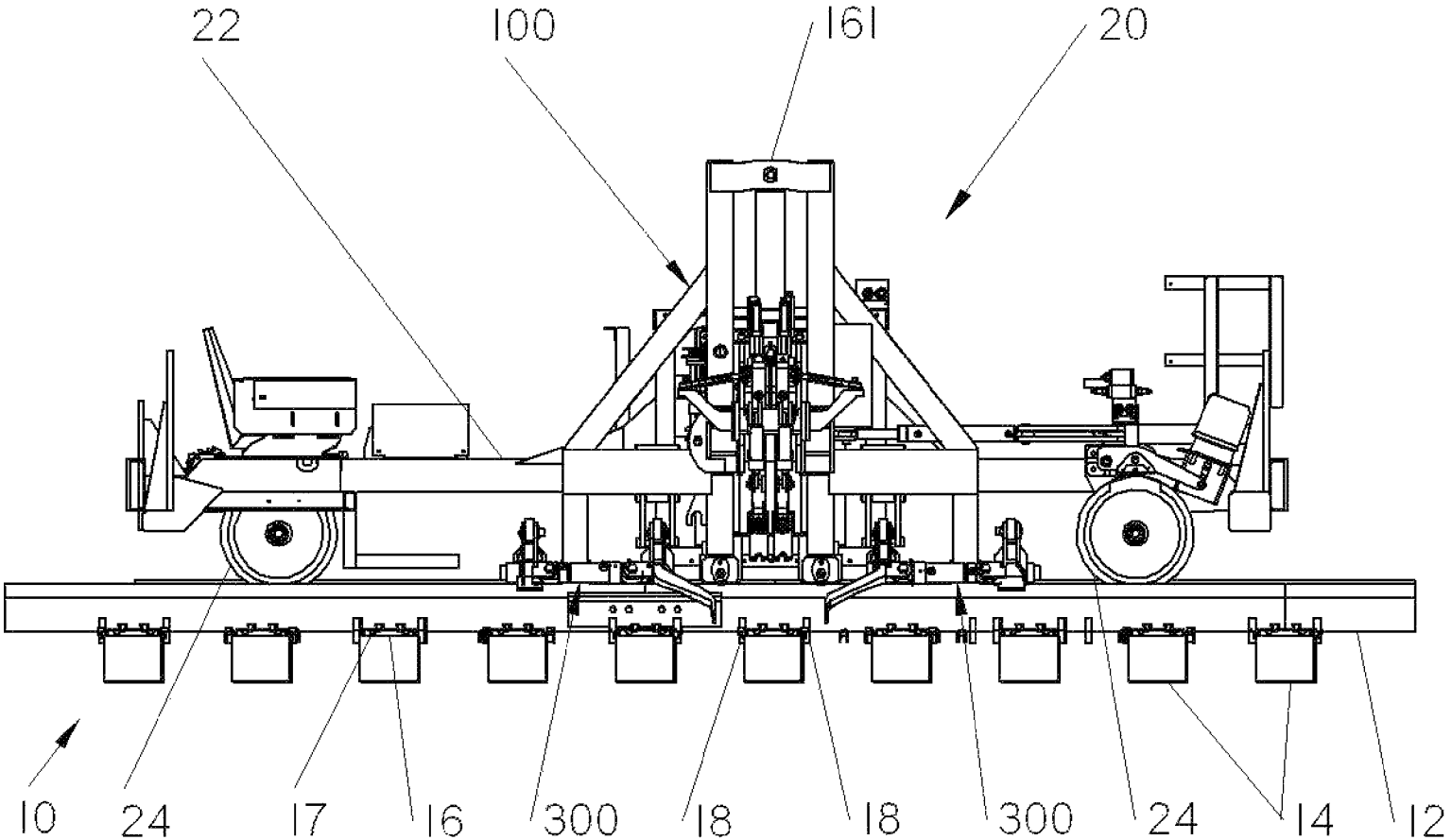
FIG. 1 is a side elevation view of a rail machine for spreading anchors and pulling spikes.

The present invention is an apparatus and method for performing railway maintenance, including removing spikes and spreading the anchors securing a rail 12 in place with respect to its tie 14, prior to replacement of the tie 14.

A typical railway 10 includes a pair of rails 12 supported by ties 14. The ties 14 are typically embedded in ballast to prevent their movement. A tie plate 16 fits between the rail 12 and the tie 14, with a plurality of spikes 17 passing through the tie 14 and tie plate 16, and having their heads overlap the bottom flange of the rail 12. The spikes 17 and tie plate 16 thereby secure the rail 12 against transverse movement with respect to the tie 14. A rail anchor 18 fits on either side of the tie 14, and is secured to the rail 12. The rail anchor 18 prevents longitudinal movement of the rail 12 with the respect to the tie 14.

During a tie 14 replacement operation, it is necessary to spread the anchors 18 apart from the tie 14, thereby making room for a new tie 14 to pass between the anchors 18. It is also necessary to remove the spikes 17 from the tie plates 16. The embodiment described herein is directed toward these functions.

Referring to FIG. 1, a rail vehicle 20 which has a spike-pulling apparatus 100 and an anchor-spreading apparatus 300. The vehicle 20 includes a chassis 22 having a plurality of wheels 24 for engaging the rails 12. The vehicle 20 is powered by a motor (not shown), which may be located on the chassis 22, where a fuel storage tank and/or battery may also be located to supply the engine. The chassis 22 may also include a hydraulic fluid which supplies hydraulic fluid to components of the vehicle 20. The engine, storage tanks and battery may be of the type known in the industry.

The vehicle 20 may include an operator's cab (not shown), which may include various operational controls which are in communication with the vehicle's electronic control system. Other configurations of the vehicle 20 may be used. In particular, the use of an operator's cab may not be required if the vehicle includes a vision system to accurately locate the spikes and the anchors. In addition, the vehicle 20 may be a drone vehicle which is controlled from a lead vehicle (not shown), which also eliminates the need for the operator's cab.

The vehicle 20 may be a stand-alone vehicle or may be satellite vehicle which is structured to move longitudinally relative to other members of a rail consist. In addition, the vehicle 20 may be a movable member of a larger rail vehicle. The satellite vehicle or movable member is structured to index or move relative to the consist while the consist and vehicle 20 are moving over the rails 12. One such movable member is described in co-pending U.S. application Ser. No. 12/827,596, filed on Jun. 30, 2010, which is hereby incorporated by reference. In this embodiment, the movable vehicle 20 is moved through the use of hydraulic cylinders or pistons. A control device is configured to control the movement of the movable vehicle 20 to properly position the spike-pulling apparatus 100 and/or the anchor-spreading apparatus 300 as required. Other known movable frame members or satellite vehicles may be used with the spike-pulling apparatus 100 and/or the anchor-spreading apparatus 300.

Referring to FIGS. 11 through 15, the spike-pulling apparatus 100 includes multiple spike-pulling heads or claws 142 for each rail 12. In the embodiment shown, four spike-pulling heads or claws 142 for each rail 12, with one pair of spike-pulling claws 142 positioned on each side of each rail 12. The spike-pulling claws 142 are supported such that they can simultaneously engage spikes 17 on opposite sides of the rails 12 and pull the spikes 17 out of the tie plates 16 and ties 14. Generally, the claws 142 each comprise a forged metal plate having a lower portion 146 (FIG. 15) including a pair of fingers 148 projecting downwardly and toward the rail 12. The fingers 148 are positioned in spaced apart relation such that they can be positioned on opposite sides of the shaft 150 of a respective spike 17 and beneath the head 152 of the spike 17. The lower portion 146 of each claw 142 also defines an aperture 154 between the fingers 148 for housing the shaft 150 of the spike when the fingers 148 are positioned under the head 152 of the spike 17. In the illustrated embodiment, the aperture 154 is tapered such that it has a substantially smaller diameter at the rearward surface of the claw 142 than at the surface facing the spike 17 to be pulled. This construction facilitates movement of the claw 142 into engagement with a spike 17 such that the head 152 of the spike 17 is securely housed in the aperture 154 in the lower portion 146 of the claw 142.

Means are also provided for supporting the claws 142 for movement from a retracted position to a position where the lower portions 146 of the claws 142 can engage spikes 17 on opposite sides of a rail 12 and then to a position wherein the claws 142 pull the spikes 17 upwardly out of the tie 14 and tie plate 16. A generally vertically extending frame structure 158 fixedly supported by the chassis 22 extends upwardly from a central portion thereof. In the illustrated embodiment, the vertically extending frame structure 158 is defined by a plurality of upwardly extending beams 159, two of the beams 159 being joined at their upper ends by a cross member 161. The upwardly extending beams 159 also fixedly support a pair of horizontally extending tracks or channels 160. The tracks 160 are vertically spaced apart with respect to one another. Other embodiments of the frame structure 158 can be used without departing from the scope of the invention.

Figure 11:
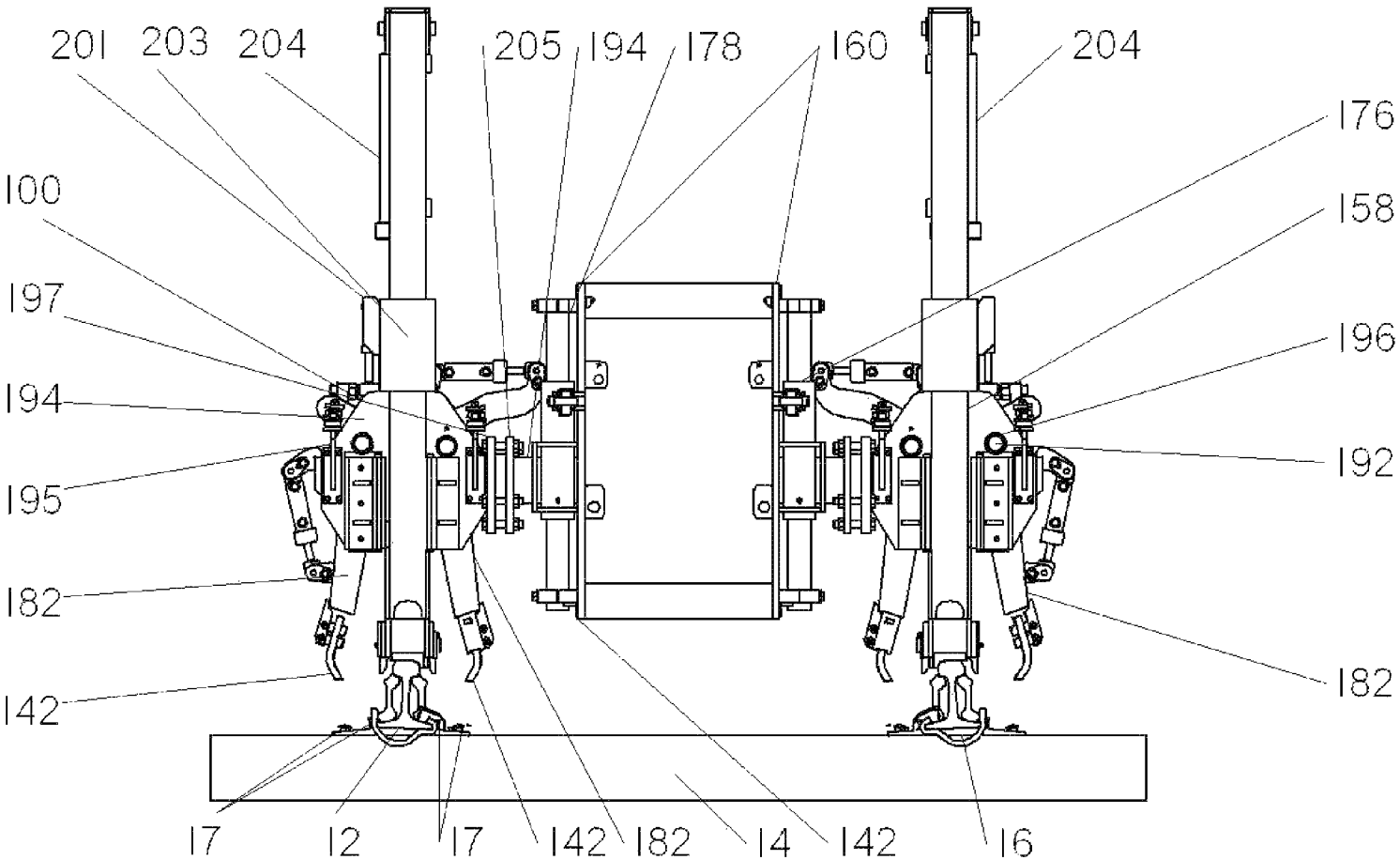
FIG. 11 is a cross section elevation view of two spike pulling apparatus of the rail machine, showing the spike pulling apparatus in a raised position above the rail.

Means are also provided for supporting the claws 142 such that the claws 142 are freely reciprocally movable with respect to the vehicle 20, horizontally forwardly and rearwardly, in the direction of the rails 12. The means for providing such horizontal reciprocal movement permits adjustment of the position of the claws 142 with respect to the spikes 17 without requiring movement of the entire vehicle 20 into accurate alignment with the spikes 17. The means for supporting the claws 142 for adjustable movement includes a pair of spaced vertically extending tubes or sleeves 176 (FIG. 11). Also included is a pair of spaced vertically extending shafts 178. The upper ends of the shafts 178 are supported by a slide block 180 supported for slidable movement in the upper track, and the lower ends of the shafts 178 are similarly supported by a slide block 180 housed in the lower horizontally extending track or channel supported by the vehicle 20. The vertically extending shafts 178 are supported for limited reciprocal horizontal movement by the slide blocks 180 to provide for adjustable positioning of the claws 142 with respect to the spikes 17.

Figure 13:
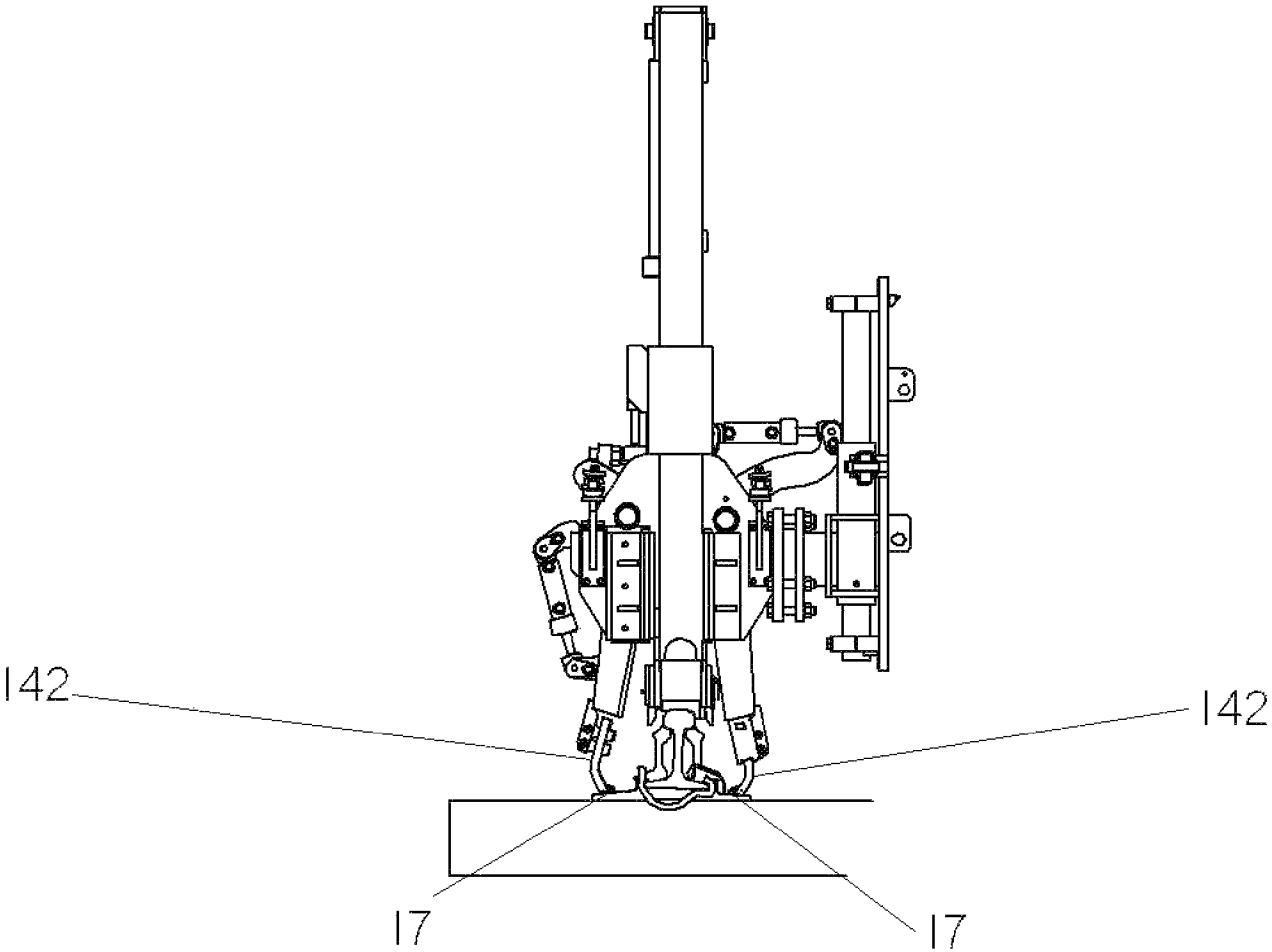
FIG. 13 is an enlarged partial view of the spike pulling apparatus similar to that of FIG. 12, showing the spike pulling apparatus in engagement with the respective spikes of a tie plate of the rail.
Figure 14:
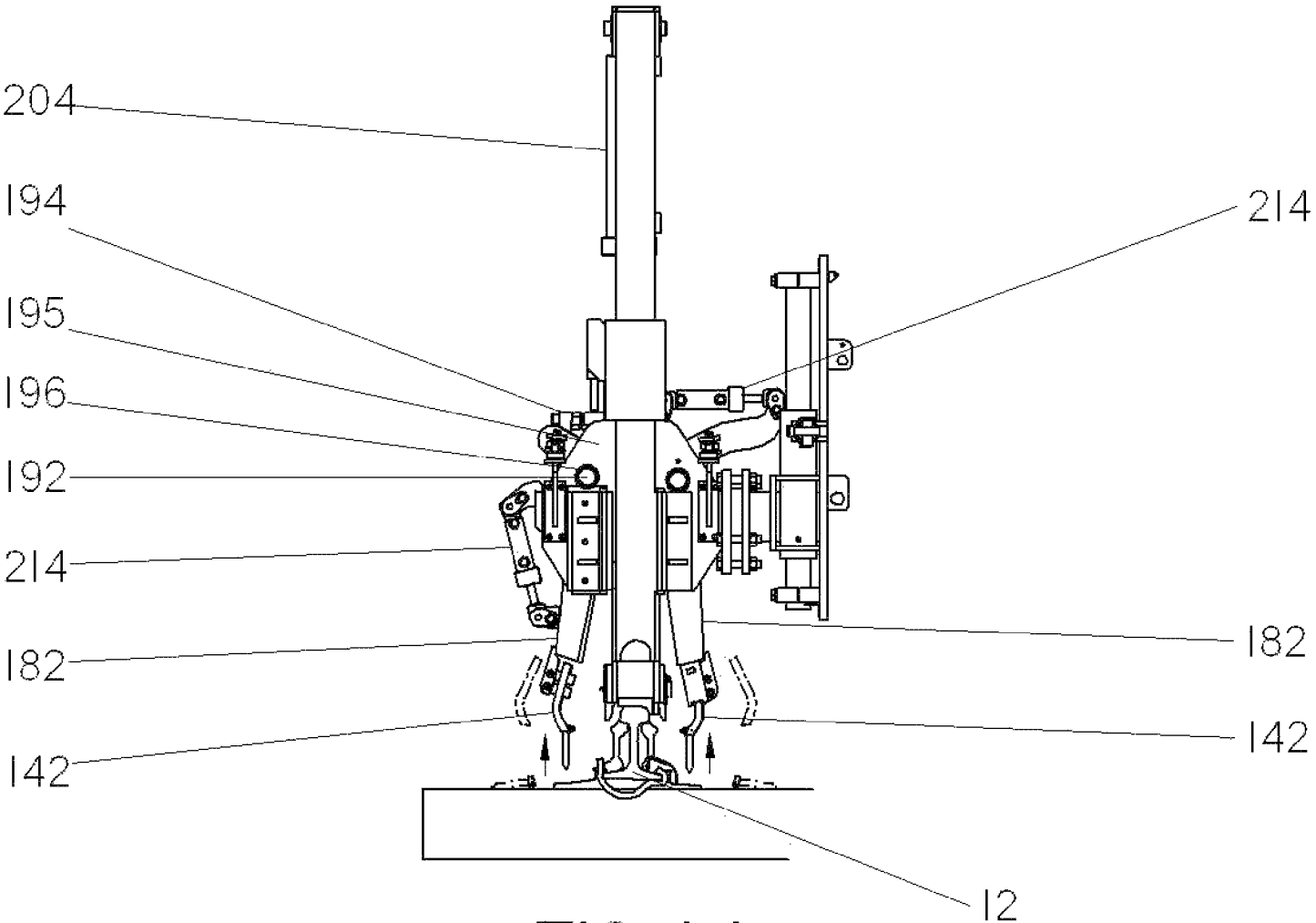
FIG. 14 is an enlarged partial view of the spike pulling apparatus similar to that of FIG. 13, showing the spike pulling apparatus pulling the respective spikes from the tie plate of the rail.
Figure 15:
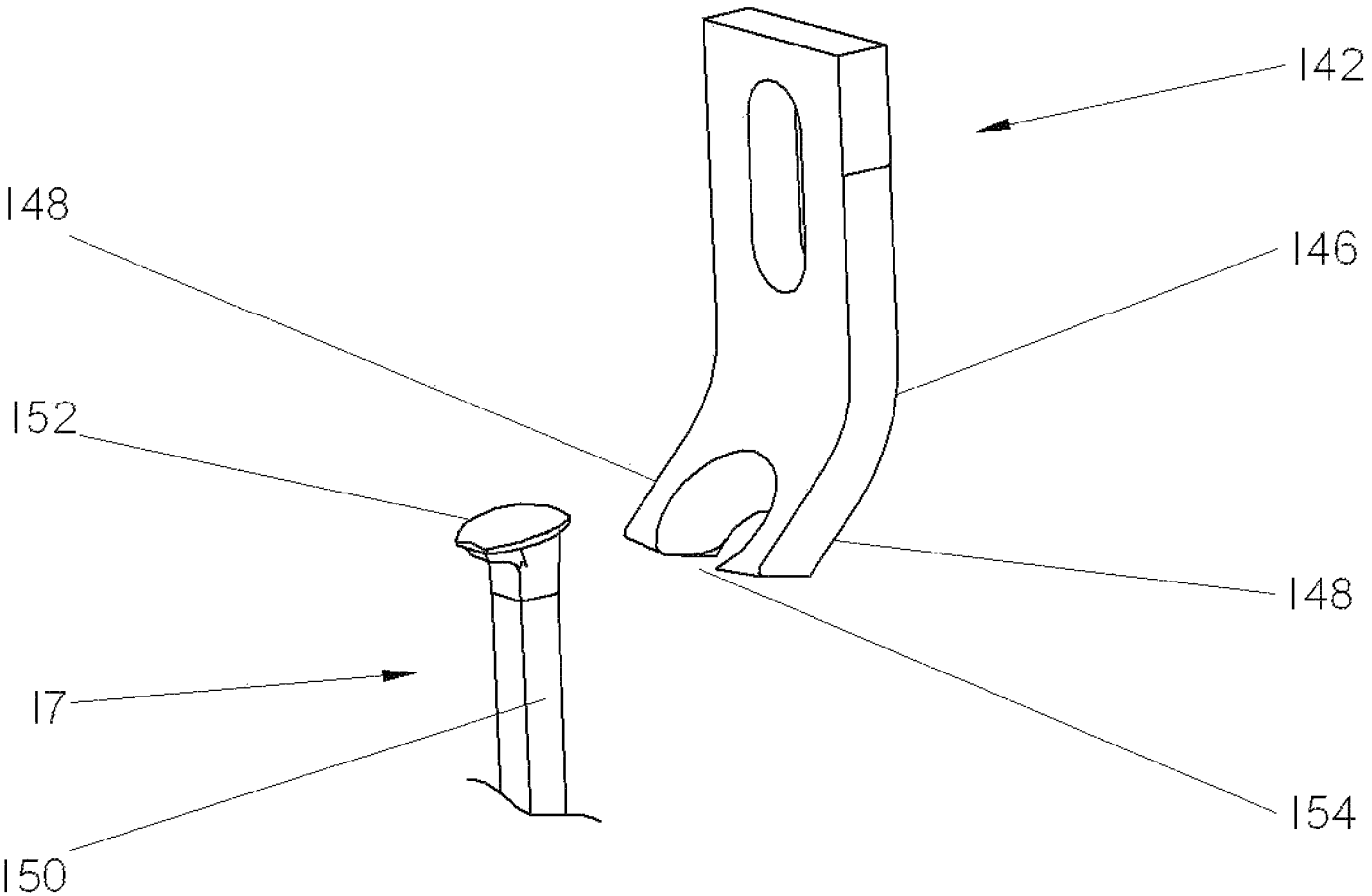
FIG. 15 is an enlarged partial view of a spike pulling claw of the spike pulling apparatus as illustrated in FIGS. 11 through 14.

The sleeves 176 surround the vertically extending shafts 178 and are supported thereon for vertical reciprocal movement between a raised position as shown in FIG. 11 and a lowered position shown in FIG. 13.

The means for supporting the claws 142 also includes a pair of pivotable support arms 182. The lower ends of the support arms 182 support the claws 142. The lower end of each support arm 182 defines a clevis 184 adapted to house the planar upper portion 186 of the claws 142. The lower ends of the support arms 182 include bores 188, and the upper portion of each of the claws 142 includes a slot 190. A pin 192 is adapted to extend through the bore 188 and slot 190 to secure the claw 142 to the support arm 182.

In embodiment shown, the clevis 184 will support the claw 142 such that it is freely pivotable or movable about the axis of the pin 192, and the slot 190 will permit limited vertical shiftable movement of the claw 142 with respect to the clevis 184. Accordingly, the claw 142 is relatively loosely supported such that the claw can align itself with the spikes 17 as it is moved into engagement with a spike.

Figure 12:
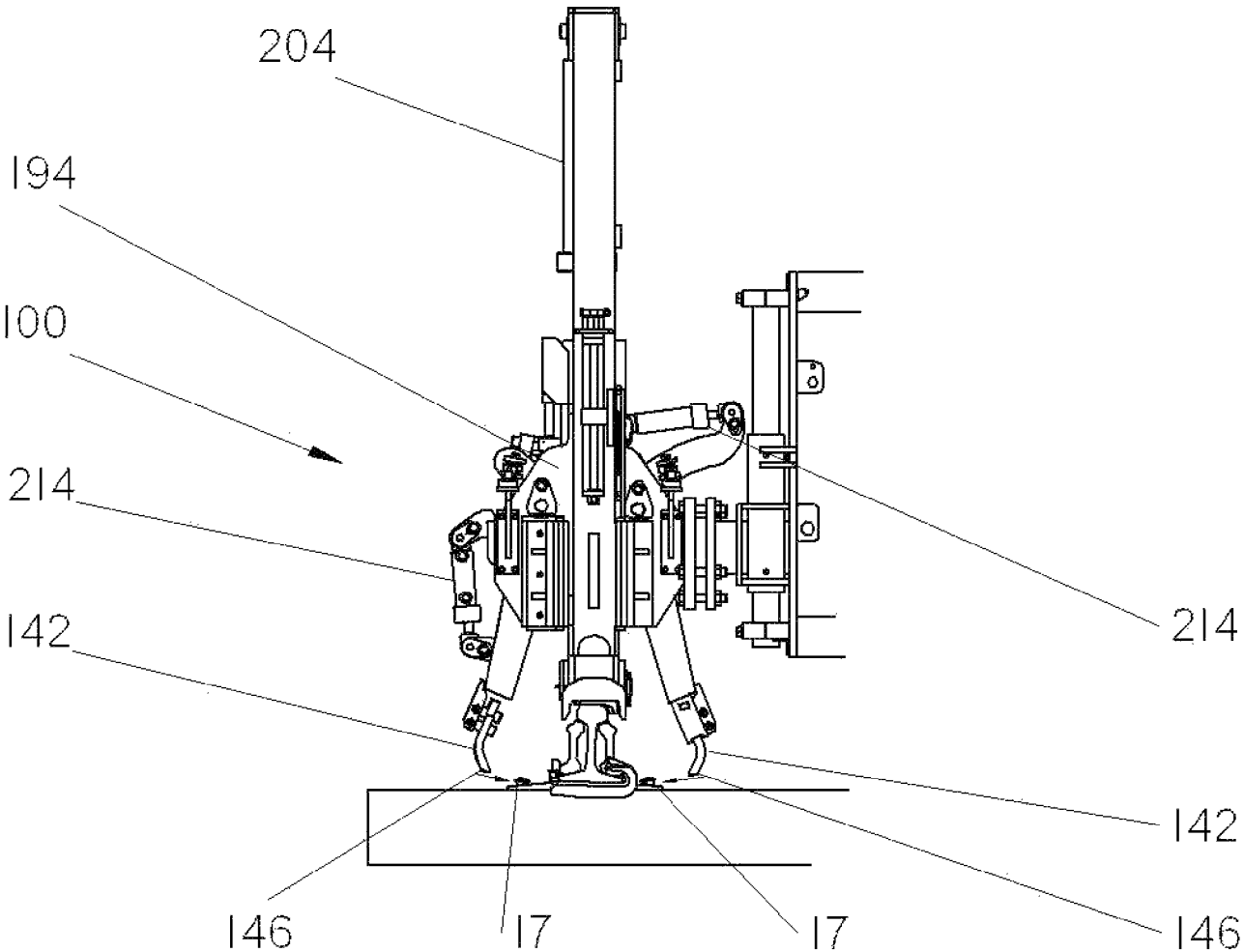
FIG. 12 is an enlarged partial view of one spike pulling apparatus of FIG. 11, showing the spike pulling apparatus proximate respective spikes of a tie plate of the rail.

The upper ends of the support arms 182 are pivotally joined to a support block 194 best shown in FIGS. 11 through 13. The support block 194 comprises a generally hollow box-like structure which is open at the top and bottom. The support block 194 includes a pair of spaced vertical side walls 195 and a pair of vertical end walls 197 and 199 joining the side walls 195. The sidewalls 195 are also joined by a connecting beam 201 extending between and rigidly joining upwardly extending portions 203 of the side walls 195. The support block 194 is rigidly joined to the tubes 176 by a pair of connecting members 205 welded to the tubes 176 and welded to the end wall 197. The support block 194 is thus supported for vertical reciprocal movement and horizontal adjusting movement with the tubes or sleeves 176.

The arms 182 are pivotally joined to the support block 194 by pivot rods or shafts 196 extending through the upper end of the support block 194 and with opposite ends of the pivot shafts 196 journalled in bores in the side walls 195 of the support block 194. The pivot shafts 196 are held in place with respect to the support block 194 by pins 198 (FIG. 14) extending through opposite ends of the shaft 196. The support arms 182 are supported by the shafts 196 for pivotable movement about spaced parallel axes, these axes being horizontal and parallel to the longitudinal axis of the rail. The pivot arms 182 are also supported such that the claws 142 supported by the pivot arms 182 move toward and away from each other and toward and away from the rail 12.

Means are also provided for causing selective vertical reciprocal movement of the support block 194, the support arms 182, and the claws 142 with respect to the rails 12 and the second frame 162. In the illustrated construction, this means includes a hydraulic cylinder 204 having one end pivotally joined by a pin to connecting bars of a frame. A cylinder rod extends downwardly from the lower end of the cylinder 204 and has a lower end pivotally connected by a pin to a flange extending upwardly from a connecting beam of the support block 194. The cylinder 204 is operable to cause vertical reciprocal movement of the support block 194 with respect to the frame.

Means are also provided for causing pivotal movement of the pivotable support arms 182 such that the claws 142 are movable toward and away from each other and toward and away from the rail 12. The means for causing such movement of the pivotable arms 182 includes a second hydraulic cylinder 214 mounted between the pivotable arms 182 and in generally horizontal relation. One end of the second hydraulic cylinder 214 is pivotally connected to one of the pivotable arms 182, and the other of the opposite ends of the second hydraulic cylinder 214 is pivotally connected to the stationary frame 195.

Referring to FIGS. 2 through 10, the rail anchor spreader apparatus 300 is illustrated. As is shown, each vehicle 20 has rail anchor spreader apparatuses 300 which are mounted on the chassis 22 of the vehicle 20. In the embodiment shown, the rail anchor spreader apparatuses 300 are positioned proximate the spike pulling apparatus 100. A pair of rail anchor spreader apparatuses 300 are positioned over each rail 12, with one rail anchor spreader apparatus 300 being positioned on either side of the spike-pulling apparatus 100, thereby allowing the spike-pulling apparatus to be positioned over the spikes 17 of the tie plate 16 and the anchor spreader apparatus 300 to be positioned proximate the rail anchors 18, as will be more fully discussed below. Each rail anchor spreader apparatus 300 is independent of the others and each rail anchor spreader apparatus 300 can move longitudinally to the rail to properly position and align the respective rail anchor spreader apparatus 300 relative to the respective tie 14 and anchor 18. As the rail anchor spreader apparatuses 300 are identical or mirror images of each other, for ease of explanation and understanding, only one rail anchor spreader apparatus 300 will be described in detail.

Figure 2:
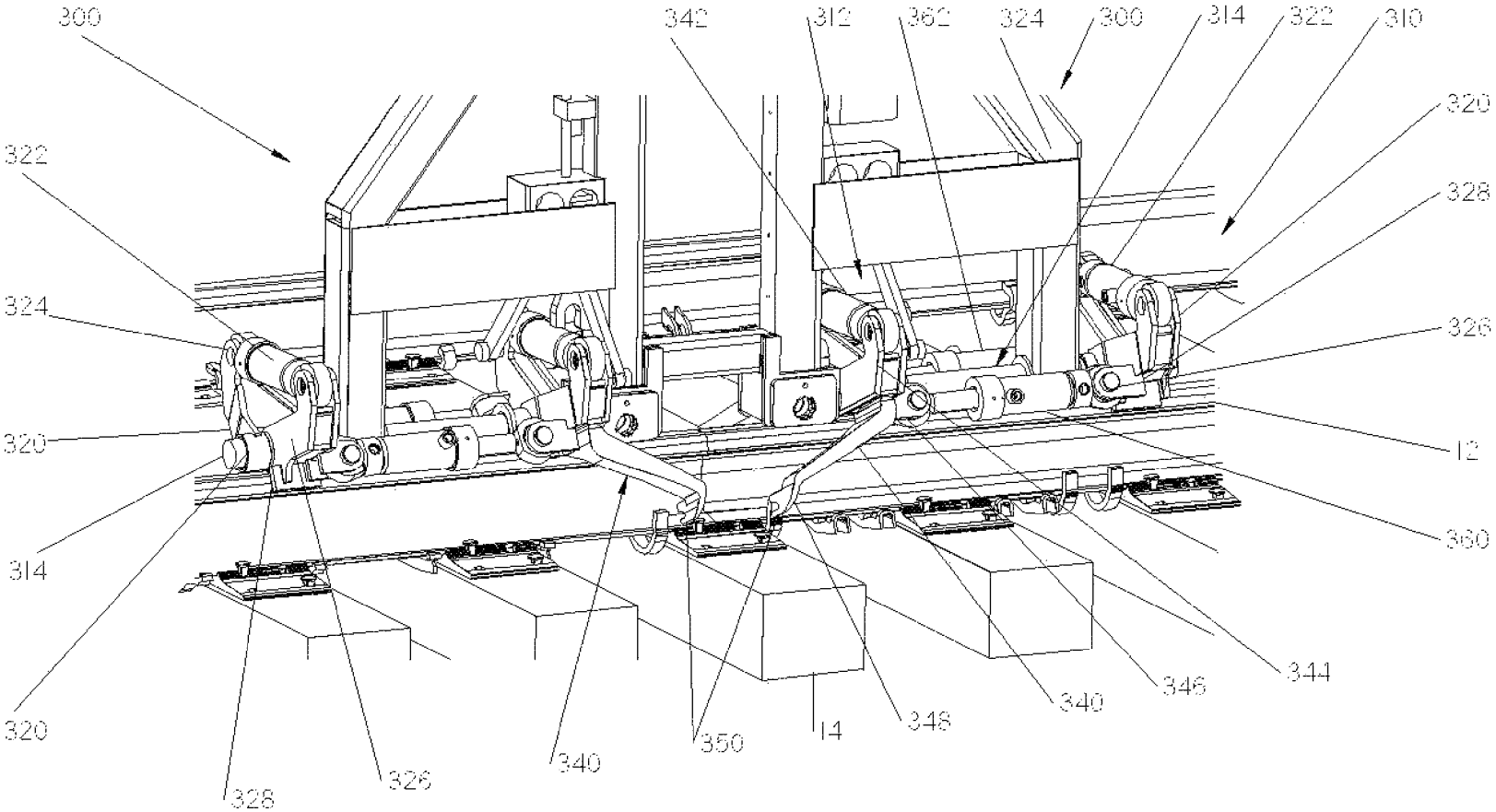
FIG. 2 is an enlarged partial view of the anchor spreader apparatus of FIG. 1, showing the anchor spreader apparatus in a raised position above a rail.
Figure 3:
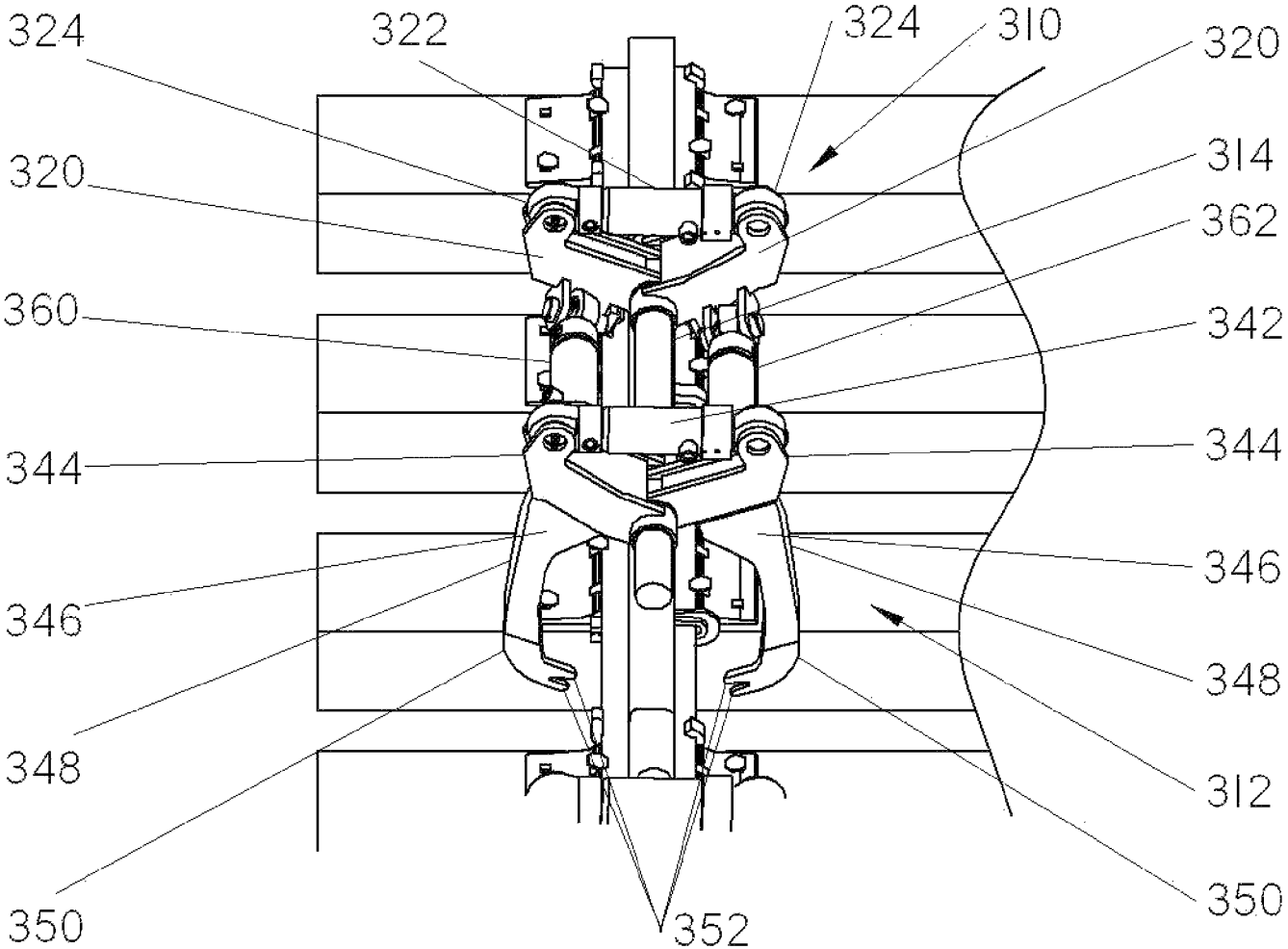
FIG. 3 is an isolated perspective view of the anchor spreader apparatus of FIG. 2.
Figure 4:
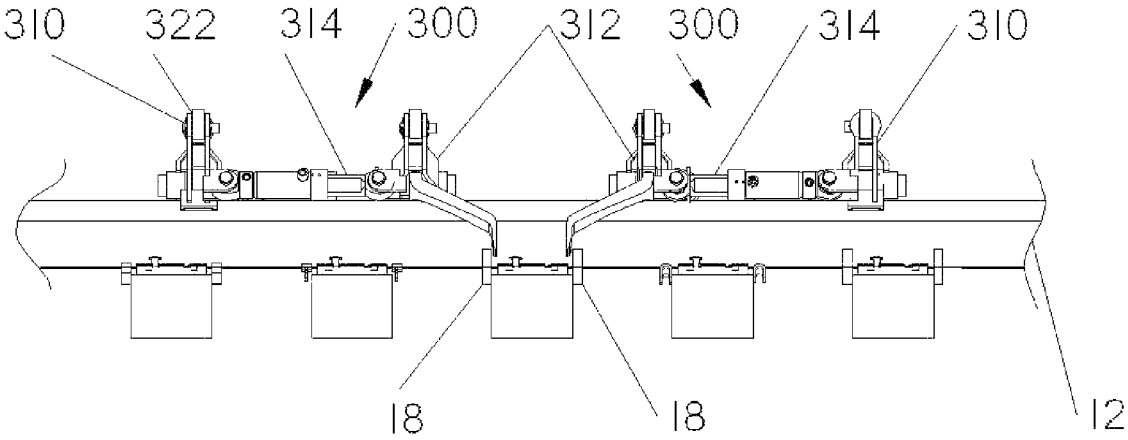
FIG. 4 is an isolated side elevation view of the anchor spreader apparatus of FIG. 2.
Figure 5:
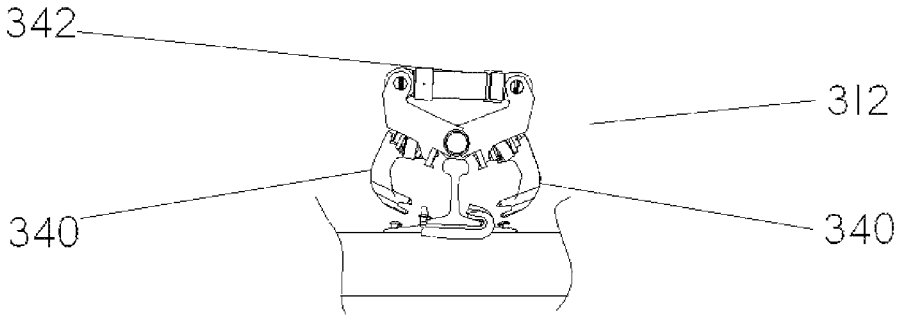
FIG. 5 is an isolated end view of the anchor spreader apparatus of FIG. 2.
Figure 6:
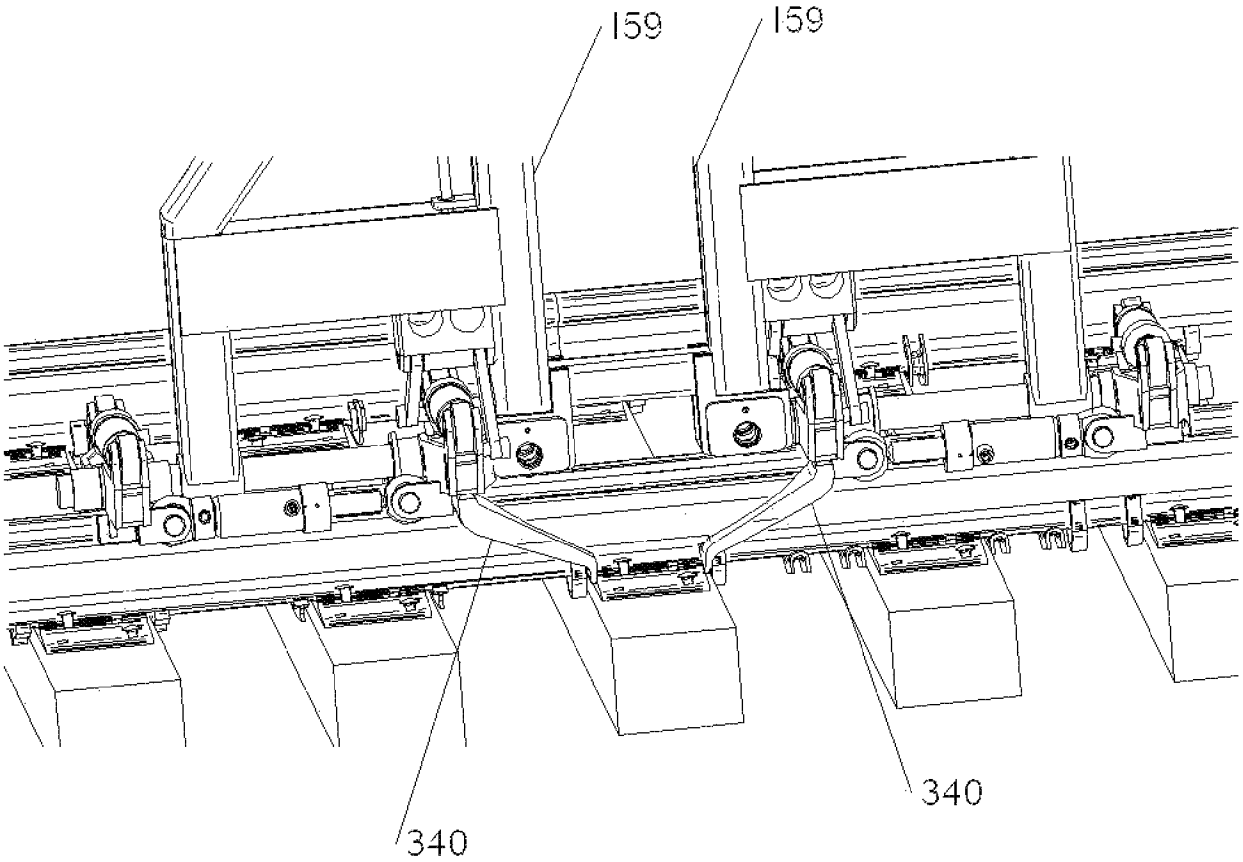
FIG. 6 is an enlarged partial view of the anchor spreader apparatus similar to that of FIG. 2, showing the anchor spreader apparatus with a rail clamp assembly engaging the rail.

Referring to FIGS. 2 through 4, each rail anchor spreader apparatus 300 includes a rail clamp assembly 310, an anchor-engaging assembly 312 and a mounting member 314 positioned therebetween. The rail clamp assembly 310 has a pair of arms 320 which are pivotally mounted to the mounting member 314. As shown in FIG. 3, the mounting member 314 has a longitudinal axis which extends in essentially the same plane as the longitudinal axis of the respective rail 12 over which the mounting member 314 is positioned. The clamp arms 320 extend from the mounting member 314 in essentially opposite directions from the longitudinal axis of the mounting member 314. A first hydraulic cylinder or piston 322 is positioned proximate or above the mounting member 314 and is pivotally connected to first mounting sections 324 provided at the ends of arms 320 which are spaced from the mounting member 314. The cylinder 322 is mounted to the mounting sections 324 in any known manner which permits the cylinder 322 to pivot relative to the arm 320 and which supports the forces associated with the movement of the arms 320 without failure. A second mounting section 326 is provided on each arm 320. The second mounting section 326 extends from each arm 320 at a location between the first mounting section 324 and the mounting member 314. A projection 328 extends from a surface of the arm 320 which is positioned proximate the rail 12. The projection has a clamping surface 330 which engages the rail 12 when the arm 320 is pivoted to a clamped position, as will be more fully described below. The clamping surface 330 may have a material or substance applied thereto to enhance the ability of the clamping surface 330 to sufficiently engage the rail 12 and to maintain the anchor spreading apparatus 300 in position as required.

The anchor-engaging assembly 312 has a pair of arms 340 which are pivotally mounted to the mounting member 314. The spreader arms 340 extend from the mounting member 314 in essentially opposite directions from the longitudinal axis of the mounting member 314. A second hydraulic cylinder or piston 342 is positioned above the mounting member 314 and is pivotally connected to first mounting sections 344 provided at the ends of arms 340 which are spaced from the mounting member 314. The cylinder 342 is mounted to the mounting sections 344 in any known manner which permits the cylinder 342 to pivot relative to the arm 340 and which supports the forces associated with the movement of the arms 340 without failure. A second mounting section 346 is provided on each arm 340. The second mounting section 346 extends from each arm 340 at a location between the first mounting section 344 and the mounting member 314. An anchor-engaging arm 348 extends from a surface of the arm 340 which is positioned proximate the rail 12. Each anchor-engaging arm 348 includes an anchor-engaging jaw 350. As shown in FIG. 3, the anchor-engaging jaw 350 may be a forged metal plate including a pair of fingers 352 projecting toward the rail 12. The fingers 352 are positioned in spaced-apart relation such that they can be positioned on the rail 12, above and below a base of the rail 12. This construction facilitates movement of the jaw 350 into engagement with an anchor 18 such that the anchor 18 is uniformly engaged by the jaw 350. Each anchor-engaging arm 348 also includes a feed position sensor. The feed position sensor senses the position of the arms and the anchors, thereby allowing the anchors to be moved a different distance on each side of the rail 12, as will be more fully described below.

Third and fourth cylinders or pistons 360, 362 are positioned on either side of the mounting member 314 and extend in essentially the same direction as the mounting member 314. The third cylinder or piston 360 extends between and is connected to respective second mounting sections 326, 346 of the arms 320, 340. Similarly, the fourth cylinder or piston 362 extends between and is connected to respective second mounting sections 326, 346 of the arms 320, 340.

In operation, as shown in FIG. 2 through 10, as the vehicle 20 is being transported to a site in which maintenance is to occur, all portions of the spike-pulling apparatus 100 and the rail anchor spreader apparatuses 300 are maintained above the rail 12, such that the rail 12 and the respective apparatus 100, 300 will not be damaged and will not interfere with travel of the vehicle 20. As the vehicle 20 is moved into a position over a respective tie 14 on which work is to be performed, the spike-pulling apparatus 100 and the anchor-spreading apparatus 300 are engaged and moved as described below. Each apparatus 300 includes a measuring device, such as, but not limited to, a LVDT or string pot, which enables the vehicle control system to precisely position the spike pulling apparatus 100 and the rail anchor spreader apparatuses 300 over the respective tie plate 16 and anchor 18, regardless of whether the tie 14 is properly aligned or skewed. Generally, the operations of the spike-pulling apparatus 100 and the anchor-spreading apparatus 300 will begin approximately simultaneously, but other timing may be required or implemented.

Upon arrival at the respective tie 14, the claws 142 of the spike-pulling apparatus 100 are moved into engagement with the spikes 17 by first actuating the first hydraulic cylinder 204 to cause downward movement of the support block 194 and the claws 142 to the position shown in FIG. 12. In this position, the lower portions 146 of the claws 142 are in generally horizontal alignment with the heads 152 of the spikes 17 and are spaced outwardly from the heads 152 of the spikes. The second hydraulic cylinder 214 is then actuated to cause movement of the claws 142 toward the rail 12 and until the fingers 148 of the claws 142 are positioned on opposite sides of the respective shafts 150 of the spikes 17 and beneath the heads 152 of the spikes, as shown in FIG. 13. In this position, the heads 152 of the spikes are housed in the apertures 154 provided in the ends of the claws 142. The hydraulic cylinder 204 is then actuated to cause upward movement of the support block 194 and the claws 142 from the position shown in FIG. 13 to the position shown in FIG. 14 wherein the spikes 17 are pulled out of the ties 14 and the tie plates 16. In embodiment shown, means are also provided for supplying a pulse of hydraulic fluid to the second hydraulic cylinder 214 to cause rapid movement of the pivotable support arms 182 and the claws 142 from the position shown in solid lines in FIG. 14 to the position shown in phantom. Such rapid movement of the claws 142 causes the claws to move away from the spikes 17 and the spikes will drop onto the ground as shown in phantom in FIG. 14. The claws 142 are then in position to repeat the spike-pulling operation.

Figure 8:
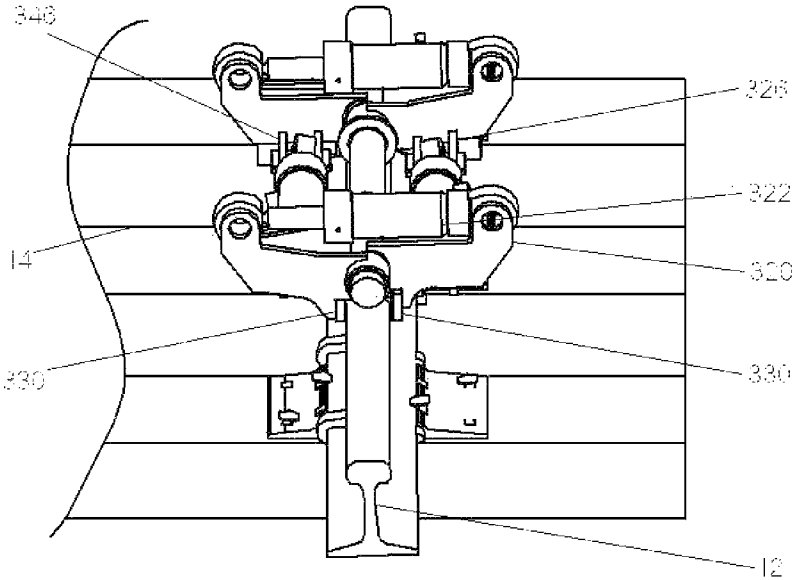
FIG. 8 is an isolated perspective rear view of the anchor spreader apparatus of FIG. 7.

Referring again to FIGS. 2 through 10, upon arrival at the respective tie 14, the jaws 350 of the anchor-spreading apparatus 300 are moved into engagement with the anchors 18. Once in position, the cylinder 322 is expanded, causing arms 320 to rotate about mounting member 314. As this occurs, the clamping surfaces 330 of the projections 328 are rotated to engage the rail 12, as shown in FIG. 8. As respective clamping surfaces 330 engage the rail 12 from both the gauge and the field side of the rail 12, the continued expansion of the cylinder 322 causes the clamping surfaces 330 and the arms 320 to clamp the ball of the rail 12 there between. The rail clamp assembly 310 has now secured the vehicle 20 against lateral or longitudinal movement. The distance between the pivot point or mounting member 314 and the projections 328 and clamping surfaces 330 is significantly less than the distance between the pivot point or mounting member 314 and the first mounting sections 324. The arm 320 will therefore act as force multiplier, so that the force with which each of the clamping surfaces 330 engages the ball of the rail 12 will be significantly greater than the force applied by the cylinder 322.

The rail clamp assembly 310 may engage rails 12 of various sizes without modification or adjustments to the clamping surface 330 itself. As the arms 320 are rotated, the clamping surface 330 is dimensioned to engage the ball of the rail 12 at any portion thereof. Additionally, as the clamping surfaces 330 are rotated, the clamping surfaces 330 may grasp the ball of the rail 12 at a point wherein two adjacent rail sections are joined.

Figure 7:
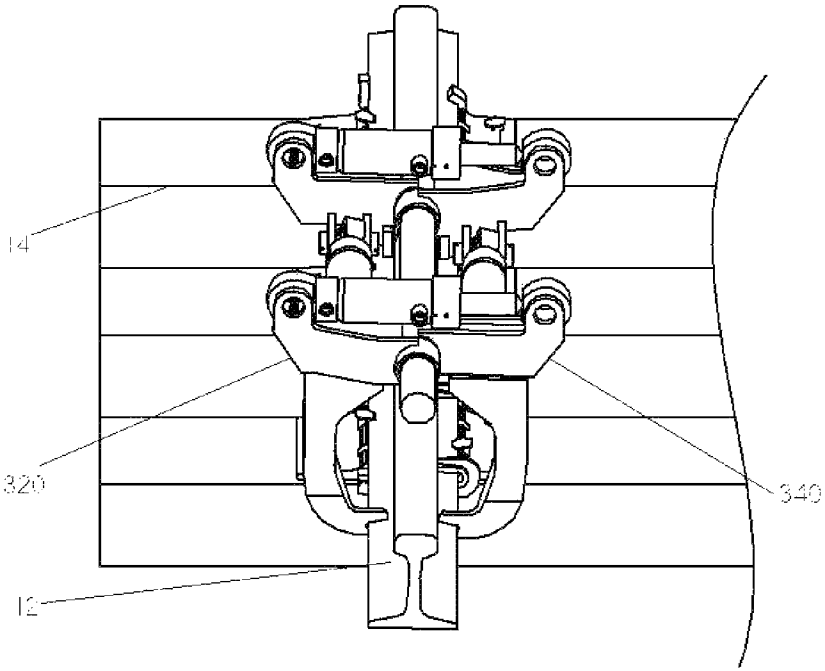
FIG. 7 is an isolated perspective front view of the anchor spreader apparatus of FIG. 6.
Figure 9:
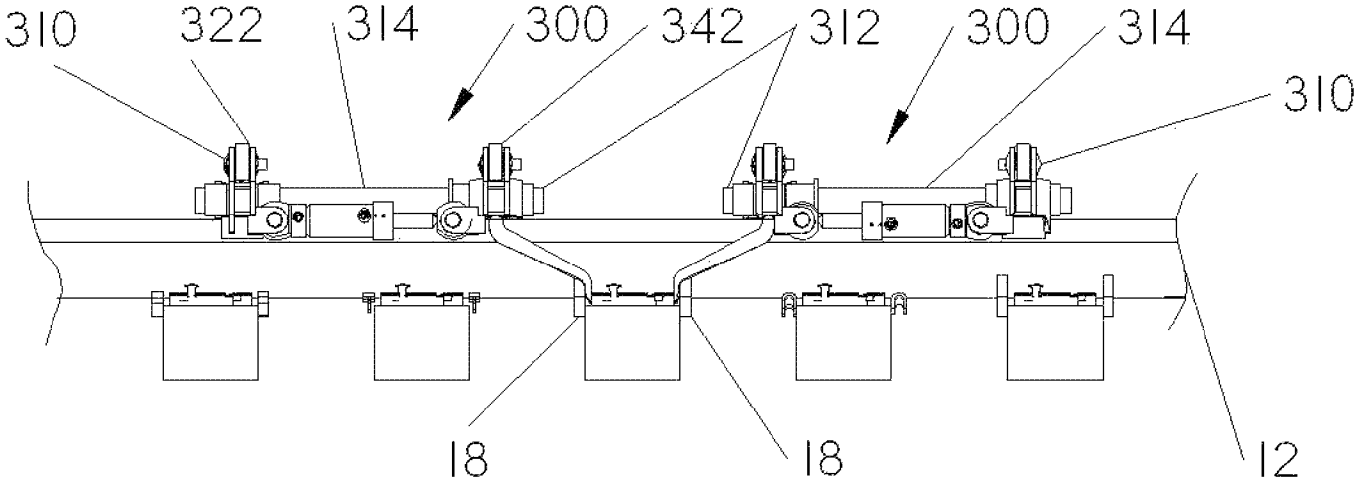
FIG. 9 is an isolated side elevation view of the anchor spreader apparatus of FIG. 6.
Figure 10:
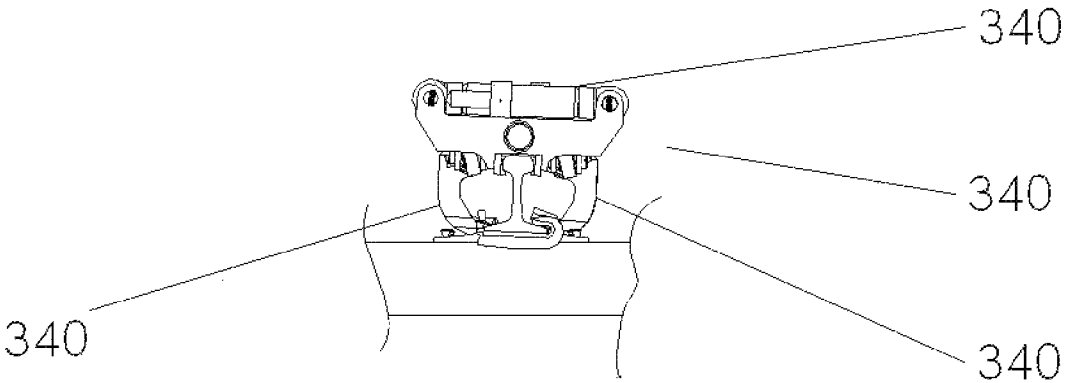
FIG. 10 is an isolated end view of the anchor spreader apparatus of FIG. 6.

With the rail clamp assembly 310 properly clamped to the rail 12, the cylinder 342 of the anchor-engaging assembly 312 is expanded causing arms 340 to rotate about mounting member 314. As this occurs, the anchor-engaging arms 348 and the anchor-engaging jaws 350 are rotated in to position to engage the anchors 18 of the rail 12, as shown in FIG. 7. By rotating the anchor-engaging jaws 350 into position proximate the anchor 18, there is less possibility of damaging the anchor 18 or the tie 14 as the anchor engaging assembly 312 is moved into position, thereby allowing the tie 14 and the anchor 18 to be reused or recycled. As respective anchor-engaging jaws 350 engage the rail 12 from both the gauge and the field side of the rail 12, the movement of the anchor 18 from the tie 14 is properly controlled to prevent the anchor 18 from being skewed and binding during movement of the anchor 18 on the rail 12. In addition, the controlled movement of the anchors 18 helps to maintain the spacing and squareness of each replacement tie 14.

With the rail clamp assembly 310 properly clamped to the rail 12 and the anchor-engaging assembly 312 properly positioned proximate the anchor 18, the third and fourth cylinders 360, 362 are retracted causing the anchor-engaging jaws 350 of the anchor-engaging assembly 312 to move along the mounting member 314 toward the rail clamp assembly 310. In so doing, the anchor-engaging jaws 350 engage and move the anchors 18 away from the tie 14, thereby facilitating the removal, repair and/or replacement of the tie 14. As the rail clamp assembly 310 is engaged with the rail 12, the anchor-spreading apparatus 300 is maintained in a proper and controlled position relative to the anchor 18. As the movement of the cylinders 360, 362 is controlled and repeatable, the movement of the anchor 18 is also controlled and repeatable, thereby facilitating the reuse of the anchors 18 when a new tie is installed. The feed position sensors sense the relative position of the anchor 18 relative to the rail 12, such that if a tie 14 is not square relative to the rail 12, the anchor 18 may be moved a differential amount on each side of the rail, thereby placing the anchor 18 square with the rail 12. The sensors also allow the anchor 18 to be properly positioned in the center between two adjacent ties 14. This allows a new tie to be placed at the midpoint of the anchors 18. In addition, as the anchors 18 are square relative to the rail 12, once the anchors into the first or engaged position, the anchors will help maintain the new tie square to the rail.

Once the anchor 18 has been moved or spread, the cylinder 342 is retracted, causing the arms 340 and anchor-engaging jaws 350 to pivot away from the anchor 18. The cylinders 360, 362 are then expanded, moving the anchor-engaging jaws 350 away from the rail clamp assembly 310. Either slightly prior to, slightly after or simultaneously with the expansion of the cylinders 360, 362, the cylinder 322 is retracted, causing the arms 320 and the clamping surfaces 330 to move away from the rail 12. With the cylinders 322, 342 retracted and the cylinders 360, 362 expanded, the anchor-engaging assembly 312 is again positioned in its initial position, as shown in FIGS. 2 through 5, thereby allowing the process to be repeated at the next appropriate tie 14.

As the operation of the spike-pulling apparatus 100 is generally complete prior to or simultaneously with the completion of the operation of the anchor-spreading apparatus 300, the movement of the vehicle 20 to the next tie 14 may begin as soon as the clamping surface 330 has been removed from engagement with the rail 12. Alternatively, if the vehicle 20 is a satellite vehicle, the vehicle 20 may advance relative to the consist as soon as the clamping surface 330 has been removed from engagement with the rail 12. However, if the spike-pulling apparatus 100 operation is not completed as the clamping surface 330 is disengaged from the rail 12, the vehicle will advance when the operation of the spike-pulling apparatus is complete.

As each of the spike-pulling apparatus 100 and the anchor-spreading apparatus 300 for each rail 12 acts independently of the spike pulling-apparatus 100 and the anchor-spreading apparatus 300 of the other rail 12, the vehicle 20 is able to accommodate skewed ties and effectively remove the spikes 17 and move the anchors 18 thereof.

A ferrous material pickup in the form of a rotating magnetic wheel straddling each rail may be used to pick up all of the loose spikes and other ferrous material. The wheel is generally mounted on the non-movable portion of the vehicle. The material is loaded onto a conveyor and subsequently into a storage hopper for bulk reclamation or in some cases dumping in "haystacks" along the track for later pickup. Sometimes the material is sorted by type or quality into different storage bins on the machine. The ferrous material pickup is not limited to a rotating magnetic wheel, but can be other devices which are configured to pick up the loose spikes.

The various features of the embodiments disclosed are advantageous over the known art. Currently, spike pulling and anchor spreading in a typical gang requires up to six machines and operators, as work on each spike and anchor must be done individually under an operator's guidance. Each of the machines in the gang must index from tie to tie and stop at the work site ties. Utilizing the apparatus as described herein allows one machine or vehicle to be used to pull multiple spikes simultaneously on each rail at one time with the heads for each rail adjustable for spike positions and skewed ties. The machine or vehicle is further enhanced and manpower further eliminated by the incorporation of an anchor spreader apparatus which can spread the anchor at the same time as the spikes are pulled. This allows one operator to monitor all of the functions of this machine or vehicle.

The optional use of a position or vision system would allow the location of the spike-pulling heads and anchor-spreading jaws to be automated. A ferrous material pickup apparatus could also be incorporated into this machine to share a common power source and eliminate another separate machine from the gang, thus minimizing the possibility of collisions. One operator would still be needed to monitor the functioning of this machine and sort the items picked up from the track.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention, which is to be given the full breadth of the appended claims and any and all equivalents thereof, will include all embodiments falling within the scope of the appended claims.

The invention claimed is:

1. An anchor spreader apparatus for moving rail anchors, which are secured to a rail, away from a tie, the anchor spreader apparatus being mounted on a rail vehicle, the anchor spreader apparatus comprising:

a mounting member;

a rail clamp assembly movably mounted on the mounting member to allow a clamping surface of the rail clamp to move into engagement with the rail; and an anchor-engaging assembly movably mounted on the mounting member to allow an anchor-engaging jaw to move into engagement with a respective rail anchor and to allow the anchor-engaging assembly to move relative to the rail clamp assembly, the anchor-engaging assembly comprising;

anchor-engaging arms;

a first cylinder positioned proximate to the anchor-engaging arms, the first cylinder causing the anchor-engaging arms to rotate about the rail;

a second cylinder connected to the anchor-engaging arms, the second cylinder causing the anchor-engaging arms to move longitudinally to the rail;

whereby with the rail clamp assembly properly clamped to the rail, the anchor spreader apparatus is maintained in a proper and controlled position relative to the anchor as the anchor-engaging arms of the anchor-engaging assembly are moved longitudinally along the mounting member.

2. The anchor spreader apparatus as recited in claim 1, wherein the rail clamp assembly has a pair of clamp arms which are pivotally mounted to the mounting member.

3. The anchor spreader apparatus as recited in claim 2, wherein the mounting member has a longitudinal axis which extends in essentially the same plane as a longitudinal axis of the rail, the clamp arms extending from the mounting member in essentially opposite directions from the longitudinal axis of the mounting member.

4. The anchor spreader apparatus as recited in claim 3, wherein a third cylinder is positioned proximate the mounting member, the third cylinder being pivotally connected to first mounting sections of the clamp arms, the first mounting sections being spaced from the mounting member.

5. The anchor spreader apparatus as recited in claim 4, wherein a projection extends from a respective surface of each clamp arm which is positioned proximate the rail, the projection having the clamping surface positioned thereon.

6. The anchor spreader apparatus as recited in claim 1, wherein the clamping surface has a material or substance applied thereto to enhance the ability of the clamping surface to sufficiently engage the rail and to maintain the anchor spreader apparatus in position as required.

7. The anchor spreader apparatus as recited in claim 1, wherein the anchor engaging assembly has a pair of spreader arms which are pivotally mounted to the mounting member.

8. The anchor spreader apparatus as recited in claim 7, wherein the mounting member has a longitudinal axis which extends in essentially the same plane as a longitudinal axis of the rail, the spreader arms extending from the mounting member in essentially opposite directions from the longitudinal axis of the mounting member.

9. The anchor spreader apparatus as recited in claim 8, wherein a third cylinder is positioned proximate the mounting member, the third cylinder being pivotally connected to first mounting sections of the spreader arms, the first mounting sections being spaced from the mounting member.

10. The anchor spreader apparatus as recited in claim 9, wherein anchor-engaging arms extend from the spreader arms, the anchor-engaging arms having anchor-engaging jaws which are configured to engage with the anchor.

11. The anchor spreader apparatus as recited in claim 1, wherein the second cylinders are positioned on either side of the mounting member and extend between and are connected to respective mounting sections of the rail clamp assembly and the anchor-engaging assembly.

12. The anchor spreader apparatus as recited in claim 1, wherein position sensors are provided proximate anchor-engaging jaws of the anchor-engaging arms, the position sensors sense the relative position of the anchor-engaging jaws and thereby the rail anchor relative to the rail, whereby the anchor-engaging jaws may be moved a differential amount on each side of the rail to place the anchor square with the rail.

13. A method for moving a rail anchor from a rail tie, the method comprising the steps of:

moving a rail anchor spreader apparatus into position over the rail anchor;

positioning clamping surfaces of the rail anchor spreader apparatus into engagement with a rail to maintain the rail anchor spreader apparatus in position relative to a rail on which the rail anchor is positioned;

rotating anchor-engaging jaws into engagement with the rail anchor; and moving the anchor-engaging jaws longitudinally to the rail toward the clamping surfaces;

whereby with the clamping surfaces in engagement with the rail, the anchor-engaging jaws engage the rail anchor as the anchor-engaging jaws are moved toward the clamping surface, causing the rail anchor to be moved relative to the tie.

14. The method as recited in claim 13, comprising the further step of:

rotating the clamping surfaces about a mounting member, the clamping surface engaging the rail from both a field side of the rail and a gauge side of the rail.

15. The method as recited in claim 13, wherein the anchor-engaging jaws engage the rail from both a gauge side and a field side of the rail, whereby as the rail anchor-engaging jaws are moved toward the clamping surface, the movement of the rail anchor from the tie is controlled to prevent the rail anchor from being skewed and binding during movement of the rail anchor on the rail.

16. The method as recited in claim 13, comprising the additional steps of:

moving each respective anchor-engaging jaw of the anchor-engaging jaws toward the clamping surfaces a different distance to square the rail anchor relative to the rail.

17. The method as recited in claim 13, comprising the additional steps of:

rotating anchor-engaging jaws away from the rail anchor;

moving the anchor-engaging jaws away from the clamping surfaces;

removing the clamping surfaces of the rail anchor spreader apparatus from the rail; and moving a rail anchor spreader apparatus into position over the next respective rail anchor.

18. A rail vehicle for performing maintenance on at least one rail, the rail vehicle comprising:

an anchor spreader apparatus having a rail clamp assembly and an anchor-engaging assembly, the rail clamp assembly cooperating with the at least one rail to properly position and maintain the anchor spreader apparatus in position relative to the at least one rail, the anchor-engaging assembly having an anchor-engaging jaw which moves longitudinally to the at least one rail to engages and moves an anchor of the at least one rail; and a spike-pulling apparatus having multiple spike-pulling heads cooperate with respective spikes to pull the spikes from tie plates associated with the at least one rail;

whereby the anchor spreader apparatus and the spike-pulling apparatus simultaneously move the anchor and pull the spikes.

19. The rail vehicle as recited in claim 18, wherein the spike-pulling apparatus has four spike-pulling heads, with two being located on the field side of the rail and two being located on the gauge side of the rail.

20. The rail vehicle as recited in claim 19, wherein the anchor spreader apparatus has rail clamp assemblies and anchor-engaging assemblies, positioned on either side of the spike-puller assembly.

21. The rail vehicle as recited in claim 18, wherein a ferrous material pickup is mounted on the vehicle, the ferrous material pickup cooperating with removed spikes to pick up the removed spikes and other ferrous material.

22. The rail vehicle as recited in claim 18, wherein the rail vehicle has a movable frame portion which is structured to move longitudinally relative to a main frame of the vehicle, the spike-pulling apparatus and the anchor-spreading apparatus being mounted on the movable frame.

23. The rail vehicle as recited in claim 18, wherein a first anchor-spreader apparatus and a first spike-puller apparatus are positioned over a first rail, and a second anchor-spreader apparatus and a second spike-puller apparatus are positioned over a second rail, whereby the anchor-spreader apparatuses and the spike-pulling apparatuses simultaneously move the anchors and pull the spikes associated with the first and second rails.

24. A method for moving a rail anchor from a rail tie and pulling at least one spike from a tie plate, the method comprising the steps of:

moving a vehicle having a rail anchor-spreader apparatus and a spike-pulling apparatus into position over the rail anchor;

moving spike-pulling heads into engagement with the at least one spike;

pulling the at least one spike from the tie plate;

positioning clamping surfaces of the rail anchor-spreader apparatus into engagement with a rail to maintain the rail anchor-spreader apparatus in position relative to a rail on which the rail anchor is positioned;

rotating anchor-engaging jaws into engagement with the rail anchor; and moving the anchor-engaging jaws longitudinally to the rail toward the clamping surfaces;

whereby with the clamping surfaces in engagement with the rail, the anchor-engaging jaws engage the rail anchor as the anchor-engaging jaws are moved toward the clamping surface, causing the rail anchor to be moved relative to the tie.

* * * * *